US006264743B1

(12) United States Patent
Cucuzza

(10) Patent No.: US 6,264,743 B1
(45) Date of Patent: Jul. 24, 2001

(54) VACUUM ASSISTED OVERSPRAY CONTROLLER AND METHOD

(75) Inventor: Carl C. Cucuzza, Loganville, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/429,886

(22) Filed: Oct. 29, 1999

(51) Int. Cl.[7] ..... B05C 5/00

(52) U.S. Cl. ..... 118/50; 118/319; 118/325; 118/326

(58) Field of Search ..... 118/50, 319, 325, 118/326; 427/296, 294, 179, 177

(56) References Cited

U.S. PATENT DOCUMENTS

| | | | | |
|---|---|---|---|---|
| 1,736,633 | * | 11/1929 | Schutte | 118/50 |
| 3,364,050 | * | 1/1968 | Rausing | 427/296 |
| 3,669,064 | * | 6/1972 | Hoelzinger et al. | 118/50 |
| 4,505,381 | | 3/1985 | Major | 198/781 |
| 4,567,064 | * | 1/1986 | Woste | 118/50 |
| 4,635,585 | | 1/1987 | Conrad et al. | 118/316 |
| 4,681,215 | | 7/1987 | Martin | 198/843 |
| 4,853,063 | | 8/1989 | Basgil et al. | 156/238 |
| 4,859,273 | | 8/1989 | Friese | 156/446 |
| 5,026,450 | | 6/1991 | Cucuzza et al. | 156/244.11 |
| 5,061,510 | * | 10/1991 | Nussbaumer et al. | 427/296 |
| 5,205,869 | | 4/1993 | Ahern | 118/324 |
| 5,372,230 | | 12/1994 | Niklewski | 193/37 |
| 5,387,777 | | 2/1995 | Bennett et al. | 219/121.43 |
| 5,415,717 | | 5/1995 | Perneborn | 156/276 |
| 5,524,740 | | 6/1996 | Conley | 193/37 |
| 5,795,391 | | 8/1998 | Niemann et al. | 118/315 |
| 5,820,692 | | 10/1998 | Baecker et al. | 134/21 |
| 5,865,290 | | 2/1999 | Scott | 193/37 |
| 5,881,338 | | 3/1999 | Armstrong et al. | 399/98 |
| 5,884,751 | | 3/1999 | Metivier | 198/496 |
| 5,932,284 | | 8/1999 | Reynolds | 427/207.1 |

* cited by examiner

*Primary Examiner*—Shrive Beck
*Assistant Examiner*—Kirsten A. Crockford
(74) *Attorney, Agent, or Firm*—Wood, Herron & Evans L.L.P.

(57) ABSTRACT

A vacuum overspray controller reduces or eliminates the overspray incident to the non-contact spray application of a coating material onto a moving, porous substrate. The vacuum assisted overspray controller exposes a first surface of the porous substrate to a vacuum pressure via one or more orifices in its peripheral surface. As a result, particles of coating material that would otherwise contribute to the overspray instead are preferentially received and retained by the second surface of the porous substrate.

5 Claims, 3 Drawing Sheets

VACUUM ASSISTED OVERSPRAY CONTROLLER AND METHOD

FIELD OF THE INVENTION

The present invention relates to the application of coatings to substrates and more particularly to an apparatus and method for controlling airborne overspray incident to the non-contact spraying of a coating material onto a moving, porous substrate.

BACKGROUND OF THE INVENTION

Many industrial processes rely upon a technique that can apply a uniform layer of coating material onto a discrete surface area of a moving, porous substrate. Applications include the manufacture of diapers, incontinence pads, and other hygienic products, as well as many other products. Among the various techniques, non-contact dispensers can apply a layer of coating material without physically touching the moving substrate surface. Typically, a non-contact dispenser sprays a stream of coating material from an outlet nozzle of a dispenser located adjacent to the substrate surface. Particles of coating material must cross an air gap between the outlet nozzle of the dispenser and the substrate surface.

In many industrial processes that apply a non-contact coating, the substrate moves quickly and this displaces air in and around the air gap between the dispenser and the substrate. The turbulent air flow induced by the moving substrate captures stray particles of coating material that rebound from the substrate surface. In addition, the speeding air deflects particles of coating material having low kinetic energy from the spray stream. These misdirected particles of coating material constitute airborne overspray and are transported by the turbulent air flow to various undesired locations within the production machinery.

As a consequence of the randomly misdirected overspray, maintenance personnel must periodically clean the machinery of accumulated coating material. If the buildup is not periodically removed, components may eventually become coated with enough material to create various problems in the machinery. For example, moving components of the machinery may prematurely wear, or otherwise be adversely affected, and require replacement. This decreases productivity, due to machine down-time during maintenance, and raises production costs. If the coating material is an adhesive, simple overspray collection methods, such as those used in powder coating processes, are inadequate since adhesives significantly coagulate and bind to collection heads, conduits, collection vessels and similar structures. In addition, simple overspray collection methods generate a waste stream for either disposal or recycling.

The prior art has failed to provide a suitable solution for reducing or eliminating non-contact coating overspray, especially with regard to non-contact coating of porous substrates. Thus, the coating industry continues to need an apparatus for capturing airborne particles of coating material not received or retained by the surface of the moving substrate.

SUMMARY OF THE INVENTION

The present invention addresses these and other problems associated with the prior art by providing an apparatus and method for the non-contact dispensing of a coating material onto a first surface of a moving substrate and for controlling overspray incident to non-contact dispensing. An apparatus and method for dispensing coating material and controlling the overspray therefrom comprises a non-contact dispenser dispensing a coating material onto a first surface of a relatively moving porous substrate and a vacuum member having a hollow interior attached to a source of vacuum pressure. As used herein, the terms "vacuum pressure" or "vacuum" are not meant to imply any specific amount of pressure other than a pressure that performs the functions stated and claimed herein. At least one orifice in the peripheral surface of the vacuum member further communicates the vacuum pressure to the second surface of the porous substrate in at least substantially the same plane as the dispensed material. In a typical case, this will be a vertical plane. Due to the porosity, the vacuum is further communicated through the thickness of the porous substrate to the first surface. As a result, airborne particles of the coating material are attracted to the first surface of the porous substrate.

Airborne particles of coating material dispensed by the non-contact dispenser will experience the vacuum pressure and accelerate towards the first surface. Particles of coating material formerly having low energy will be less susceptible to the influence of the air flowing about the moving substrate due to the influence of the vacuum pressure. In addition, a particle of coating material is less likely to rebound and be transported away by the moving air flow. When a particle strikes the surface of the porous substrate, the vacuum pressure adds to the normal binding force at the instant the coating material impacts the substrate. These physical phenomena reduce the probability that any single particle of coating material will contribute to airborne overspray.

A secondary benefit of the applied vacuum pressure is that the moving substrate itself will be attracted to the surface of the vacuum member. This attractive force will aid in registering the moving substrate surface with the nozzle outlet of the liquid dispenser so that the dispenser more precisely applies the coating material.

In a preferred embodiment, the vacuum member freely rotates about a longitudinal axis thereof and supports the moving substrate as it passes the non-contact dispenser. Preferably, the vacuum member is cylindrical. In one aspect, the vacuum member rotates about the axis of a stationary shaft.

In another aspect, the stationary shaft is hollow and is connected to the source of vacuum pressure. The surface of the shaft has one or more orifices that communicate the vacuum pressure to the interior of the vacuum member.

Another feature of the invention controls the surface area of the vacuum member that is actively communicating vacuum pressure to the substrate. More specifically, the rotating vacuum member may be housed inside a stationary cradle which has a longitudinal opening in its surface to expose only a portion of the surface of the vacuum member. Only orifices in the exposed portion of the vacuum member can act upon the substrate.

One advantage of the vacuum assisted overspray controller is that the airborne overspray of adhesive particles can be controlled in an industrial process that dispenses a stream of coating material through an air space onto a porous substrate.

Another advantage of the vacuum assisted overspray controller is that the airborne overspray of coating material for a non-contact coating dispenser is deposited on the intended porous substrate, rather than collected for disposal as a waste stream or recycled for respraying.

Another advantage of the vacuum assisted overspray controller is that it can be readily incorporated into a conveying system for transporting a porous substrate past a non-contact coating dispenser.

Another advantage of the vacuum assisted overspray controller is that the vacuum pressure aids in the proper registration of the porous substrate for receiving the stream of particles or beads from a non-contact coating dispenser.

Another advantage of the vacuum assisted overspray controller is that the present invention can be easily retrofitted to existing production machinery.

Additional features, advantages and objectives of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
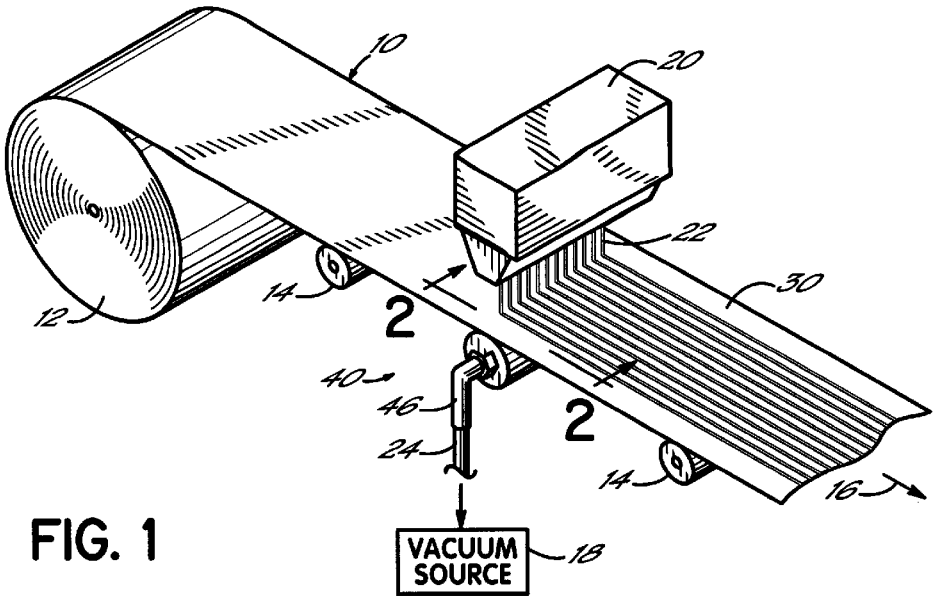
FIG. 1 is a perspective view of the vacuum assisted overspray controller employed in a conveying system that is moving a porous substrate past a liquid adhesive dispenser.

FIG. 1 schematically illustrates a porous substrate being processed within an industrial machine. In a typical industrial process, the porous substrate 10 is subjected to a plurality of manufacturing steps that transform the starting materials into a finished product. To advance between successive manufacturing steps, the porous substrate 10 is continuously transported by a conveying system.

As depicted in FIG. 1, the porous substrate 10 can originate in bulk from a supply roll 12. During the industrial process, the porous substrate 10 is continuously unwound from the supply roll 12. A conveying system comprising a plurality of roller assemblies 14, or other similar structures, guides the motion of the porous substrate 10. The porous substrate 10 is translated along a path in a direction shown by the arrow 16.

Driven roller assemblies can impart the translation of the moving substrate. Idler roller assemblies passively change the direction of motion or merely provide mechanical support. Idler rollers that contact the substrate will have an angular velocity proportional to the linear velocity of the moving substrate. In some conveying systems, the linear velocity of the porous substrate 10 can approach 1200 linear feet per minute. As a result, the flow of air about the porous substrate can be rapid.

In FIG. 1, a non-contact dispenser 20 of coating material is mounted adjacent to the moving porous substrate 10. Coating material is periodically dispensed from one or more outlet nozzles (not shown) as a spray or beads. It may be understood that the coating material being dispensed can be a glue or adhesive material such as a hot melt adhesive, cold glues, paints, or other materials of adhesive or non-adhesive nature.

The present invention will be described hereinafter as dispensing liquid in the form of adhesive particles 22, but the dispensed liquid is not limited thereto. In one aspect, the adhesive particles 22 may consist of small adhesive fibers. Also, many different types of non-contact dispensers of coating material will benefit from the inventive concepts disclosed and claimed herein.

Adhesive particles 22 exit the non-contact dispenser 20 having a distribution of momenta since, due to the statistical nature of aggregation and other variables, the mass and velocity of individual adhesive particles 22 will vary. An air gap exists between each outlet nozzle and a first surface 30 of the porous substrate 10. Adhesive particles 22 are airborne as they traverse the air gap.

As the moving porous substrate 10 passes the non-contact dispenser 20, the first surface 30 of the porous substrate 10 receives the adhesive particles 22. Most adhesive particles 22 strike the first surface 30 and bind thereto. However, a small fraction of the adhesive particles 22' can elastically or inelastically rebound from the substrate surface 30. Likewise, a small fraction of adhesive particles 22" can be redirected before striking the substrate by the flow of air acting in the air space between the non-contact dispenser 20 and substrate surface 30. The number of redirected adhesive particles 22" will depend upon the magnitude of the air flow and the energetics of the adhesive particles 22. Light, fine adhesive fibers are particularly sensitive to the air flow. Stray adhesive particles 22', 22" that are not received and retained by the substrate will escape into the environment surrounding the non-contact dispenser and contribute to the deleterious phenomenon of overspray.

A vacuum assisted overspray controller 40, as described by the present invention, is incorporated into the conveying system of FIG. 1 proximate to the non-contact dispenser 20. A support structure for the vacuum overspray controller is shown in phantom. The purpose of the vacuum assisted overspray controller 40 is to reduce or eliminate airborne overspray incident to the spraying operation. The vacuum assisted overspray controller 40 accomplishes this objective by applying a vacuum pressure to the backside of the porous substrate 10. Due to its simple structure, the vacuum assisted overspray controller 40 can be retrofitted to an existing industrial machine, as well as installed when the industrial machine is initially assembled.

Figure 2:
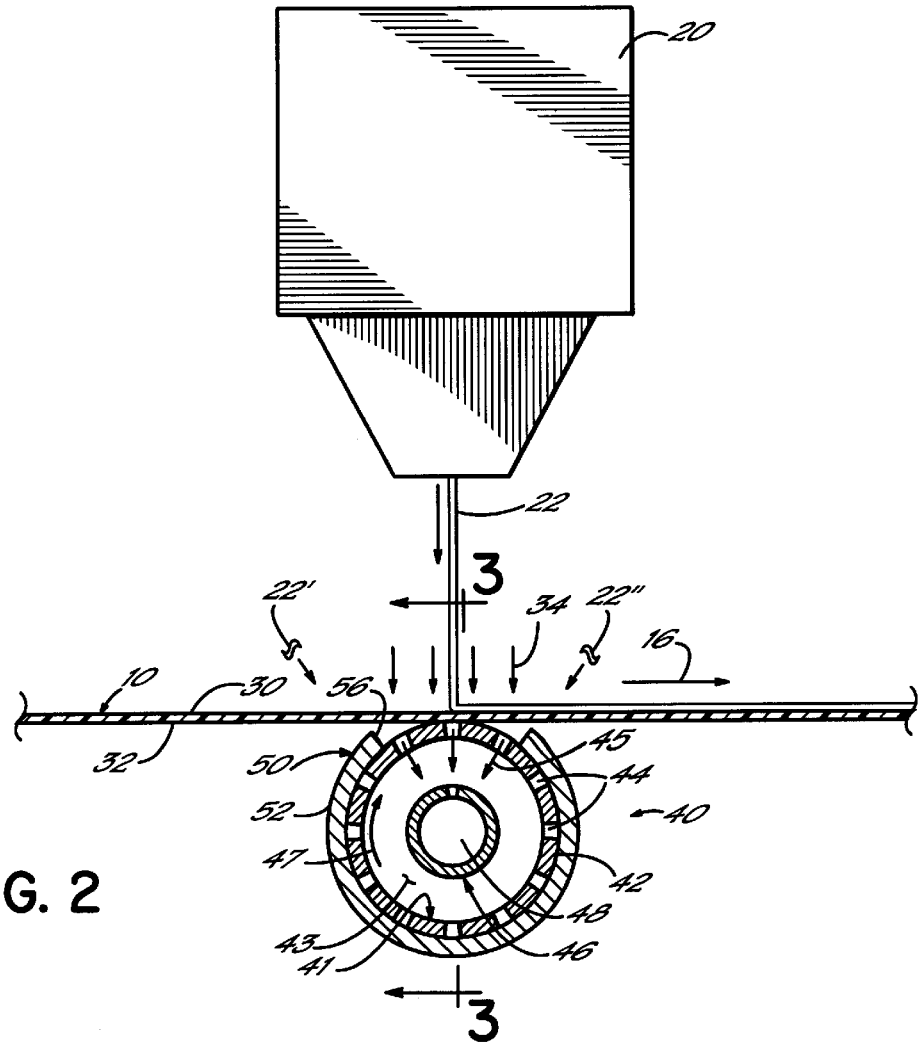
FIG. 2 is a partially cross-sectioned view taken along line 2—2 of FIG. 1.
Figure 3:
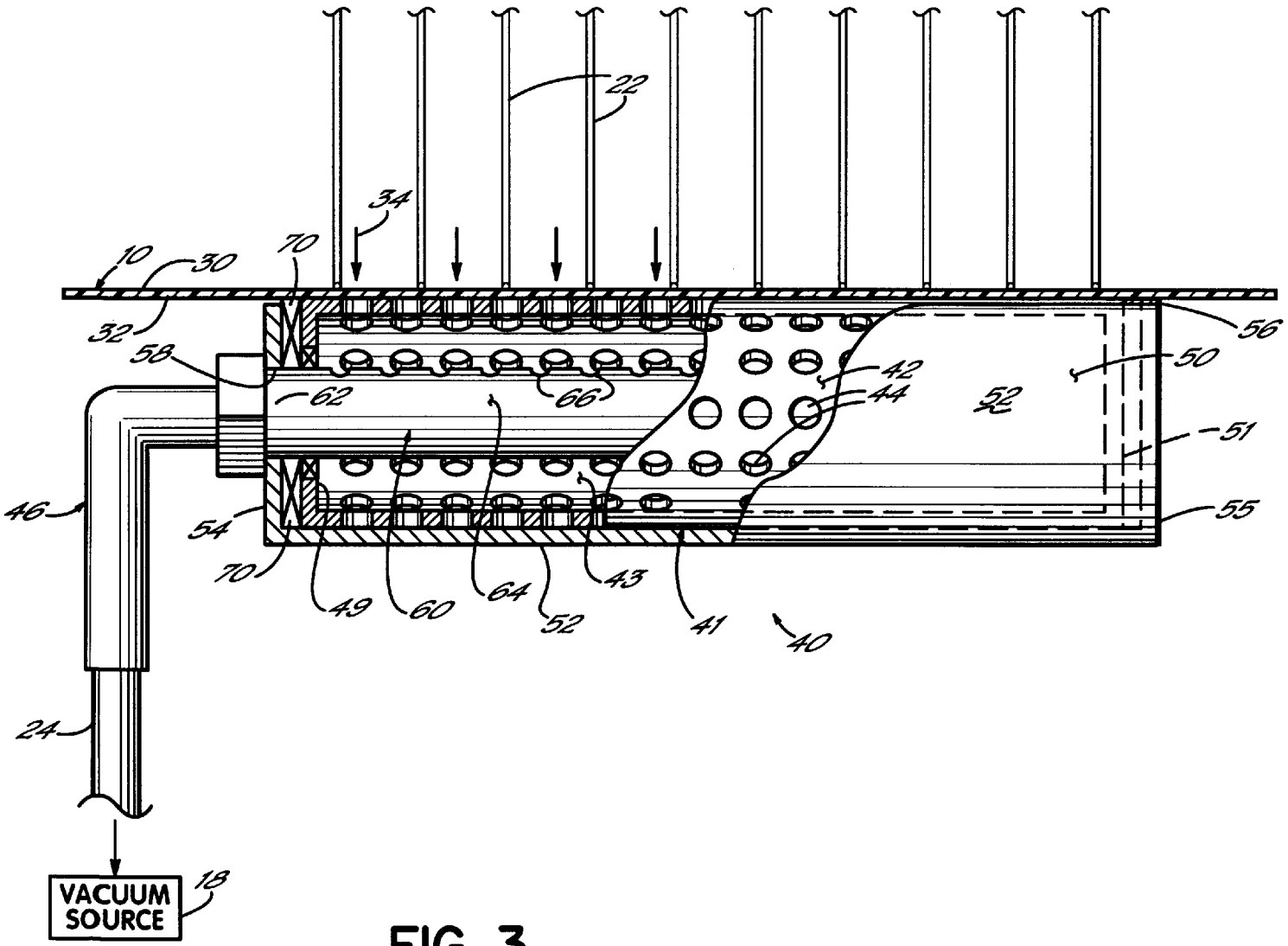
FIG. 3 is a partial cross-sectional view of the embodiment shown in FIG. 2, taken generally along line 3—3 of FIG. 2.

FIGS. 2 and 3 illustrate one embodiment of the vacuum assisted overspray controller 40. As shown in FIG. 2, the overspray controller 40 includes a vacuum member 41 having an outer peripheral surface 42 having at least one orifice 44. In the embodiment shown, the vacuum member 41 has a plurality of orifices 44 and the orifices 44 perforate the peripheral surface 42 at 30° intervals about the circumference. However, it may be understood that the arc between adjacent orifices 44 or the number and size of orifices 44 may differ. In some embodiments, the orifices 44 may be randomly positioned about the peripheral surface 42. Orifices of other shapes, such as slots, may be used as well.

As shown in FIG. 3, a source of vacuum pressure 18 evacuates air from the interior of the vacuum member 41 via the bore 48 of an attached fitting 46. As a result, the pressure within the cavity 43 defined by the peripheral surface 42 is less than the ambient atmospheric pressure outside of the overspray controller 40. The interior pressure therefore may be characterized, and will be referred to hereinafter, as a vacuum pressure. The applied pressure will vary according to the application needs. Vacuum sources 18 for supplying a vacuum pressure are conveniently found in various locations in a production machine. A conduit 24 is attached to the vacuum source 18 for communicating the vacuum pressure to the interior of the vacuum assisted overspray controller 40.

Returning to FIG. 2, the vacuum assisted overspray controller 40 is mounted proximate to, and intervenes between, the non-contact dispenser 20 and the porous substrate 10. As one example, the porous substrate 10 may be a nonwoven fabric composed of natural fibers, synthetic fibers, or a blend thereof and comprises a planar sheet having two parallel, opposed surfaces, first and second surfaces 30, 32, respectively. The first surface 30 of the porous substrate 10 receives the stream of adhesive particles 22 dispensed by the non-contact dispenser 20.

The orifices 44 in the vacuum member 41 are positioned proximate to the second surface 32 of the porous substrate 10. As the porous substrate 10 moves in the direction indicated by the arrow 16, the peripheral surface 42 of the vacuum member 41 contacts the second surface 32. In one embodiment, the vacuum member 41 is adapted to rotate about its longitudinal axis in a direction shown by the arrow 47. However, it may be understood that the second surface 32 does not have to touch the peripheral surface 42 of vacuum member 41. If the surfaces do not contact, then vacuum member 41 does not have to be adapted for rotation.

Vacuum pressure is communicated from the interior of the overspray controller through each exposed orifice 44 in the peripheral surface 42. In the embodiment shown, the peripheral surface 52 of an outer cradle 50 (to be discussed below) includes a longitudinal opening 56 that exposes only a limited number of orifices 44 at any given time during rotation of vacuum member 41. Orifices 44 shielded by the peripheral surface 52 are otherwise sealed.

An air pressure gradient is generated in the gap between the surface 30 of the porous substrate 10 and the non-contact dispenser 20. The deviation from ambient atmospheric pressure decreases with increasing distance from the orifices 44. The pressure differential produces an attractive force in the direction shown by the arrow 34. Air and airborne adhesive particles 22 will be accelerated towards the upper surface 30 of the moving porous substrate 10. As the adhesive particles 22 traverse the air space, their momenta are increased by the increased velocity.

Air molecules are transmitted through the porous substrate 10 and are pumped through each orifice 44, in the direction shown by arrow 45, by the source of vacuum pressure 18. Large objects, such as adhesive particles 22, are captured by the upper surface 30 of the substrate 10. In effect, the porous substrate 10 functions as a filter to trap the adhesive particles 22. Since only air molecules are transmitted completely through the porous substrate 10, the source of vacuum pressure 18 does not have to handle the adhesive particles 22 and dispose of them. As a result, a waste stream is not generated as an artifact of the reduction or elimination of airborne overspray.

Adhesive particles 22 formerly having low momenta will be less susceptible to the influence of the turbulent flow of air associated with the moving porous substrate 10. In addition, the probability is reduced that any single adhesive particle 22 will rebound and be transported away by the air flow. When an adhesive particle 22 strikes the surface, the force of the vacuum pressure adds to the normal binding force at the moment of impact. These physical phenomena reduce the probability that any single adhesive particle 22 will contribute to overspray.

Referring to FIG. 3, the vacuum assisted overspray controller 40 preferably includes the vacuum member 41 surrounded by the outer cradle 50. The vacuum member 41 has opposed ends 49, 51 and a peripheral surface 42 that includes a plurality of orifices 44. Preferably, vacuum member 41 is cylindrical.

Vacuum member 41 is disposed within the interior of the outer cradle 50. The cradle 50 and vacuum member 41 are preferably concentric. Outer cradle 50 comprises a hollow, elongate member having opposed end walls 54, 55, and a peripheral surface 52. In the preferred embodiment, the end walls 54, 55 of the outer cradle 50 form a vacuum seal for the respective ends 49, 51 of the vacuum member 41. However, it may be understood that each end 49, 51 of the vacuum member 41 may seal the cavity 43 therein without the necessity for the outer cradle 50.

In this aspect, the referenced vacuum seal need only be adequate to supply a sufficient vacuum pressure to orifices 44 so as to reduce or eliminate overspray. The referenced vacuum seal does not need to render the ends 49, 51 of vacuum member 41 vacuum tight.

Peripheral surface 52 of the outer cradle 50 includes the longitudinal opening 56 that exposes a limited number of orifice 44 in the peripheral surface 42 of the vacuum member 41 to the second surface 32 of the porous substrate 10. Preferably, the portion of the vacuum member 41 sealed is two thirds to one half of its total surface area. The longitudinal opening 56 is oriented so that the peripheral surface 42 of the vacuum member 41 is revealed proximate to the second surface 32 of the porous substrate 10. As the vacuum member 41 rotates, the exposed portion of the peripheral surface 42 varies. Preferably, the longitudinal opening 56 is coextensive with the lateral portion of surface 30 that is receiving the adhesive particles 22. The purpose of the outer cradle 50 is to prevent extraneous airborne material, such as stray fabric fibers originating from the moving porous substrate 10, from being drawn to portions of the vacuum member 41 not communicating with substrate 10.

In the preferred embodiment, the orifices 44 in the vacuum member 41 are arranged so that the vacuum pressure will be roughly constant in the space exposed by the longitudinal opening 56 as the vacuum member 41 rotates. No single pattern of orifices 44 is required. However, the orifices 44 must be arranged with appropriate circumferential spacing, appropriate longitudinal spacing, and in an adequate number to reduce or eliminate overspray. Although the orifices 44 shown in FIG. 3 are round, that choice is not intended to be limiting. Each orifice 44 may be slotted, triangular, oval, or another shape.

As a more specific aspect of the invention, a hollow, elongate shaft 60 is disposed within the interior of the vacuum member 41. Shaft 60 has opposed ends 62 (only one end shown) and a peripheral surface 64. End 62 protrudes through an aperture 58 in end wall 54 of the cradle 50 and is connected by the conduit 24 with the vacuum source 18. The opposed end extends into the interior of the vacuum member 41 and is conterminous with end wall 55. When actively evacuated by the vacuum source 18, the pressure within the interior of the shaft 60 is reduced to a vacuum pressure below ambient atmospheric pressure.

The peripheral surface 64 of the shaft 60 includes one or more orifices 66 that further communicate the vacuum pressure to the cavity 43 of the vacuum member 41. The orifices 66 are preferably round, but may be rectangular, triangular, oval, or another shape. Although the orifices 66 are shown aligned, their placement may be otherwise or may be random.

In this preferred embodiment of the vacuum assisted overspray controller 40, the vacuum member 41 contacts the moving porous substrate 10 and rotates about a longitudinal axis of the shaft 60. The shaft 60 serves as a mechanical support for the rotation of vacuum member 41. One end of the shaft 60 is connected to an adjacent support structure (not shown). A suitable support structure is, for example, a structural wall of the industrial machine. A roller bearing assembly 70, or similar structure, is mounted to the shaft 60 to facilitate rotation of the vacuum element 41 relative to the stationary outer cradle 50. The periphery of the roller bearing assembly 70 is attached to cradle 50 and a central hole (not shown) in the bearing assembly 70 mounts the fixed shaft 60.

Figure 4:
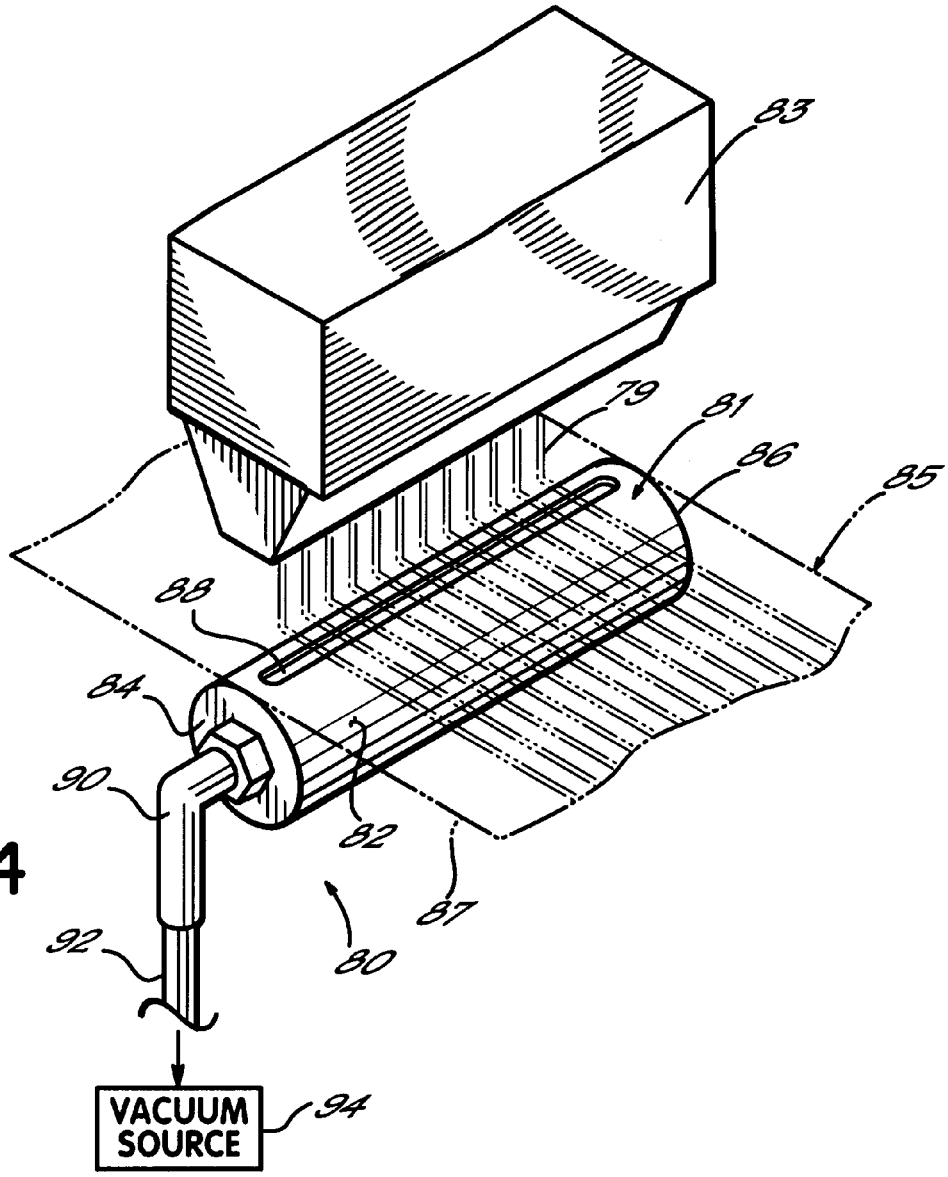
FIG. 4 is a perspective view of an alternative embodiment of the vacuum assisted overspray controller positioned proximate to a moving porous substrate receiving liquid adhesive from an adhesive dispenser.

FIG. 4 shows an alternative embodiment of the vacuum assisted overspray controller 80. In this embodiment, the overspray controller 80 comprises an elongate vacuum member 81 having a peripheral surface 82 and sealed end walls 84,86. The peripheral surface 82 includes a single elongate, rectangular orifice 88 disposed along the longitudinal axis of the vacuum member 81. However, it should be understood that the shape and dimensions of the orifice 88 may be varied. In addition, the peripheral surface 82 may include a plurality of orifices 88.

Orifice 88 is oriented so it is proximate to a second surface 87 of the moving porous substrate 85. Adhesive particles 79 are dispensed by non-contact dispenser 83 onto the second surface 87. The vacuum member 81 remains stationary and the porous substrate 85 is either in slideable contact or proximate to the orifice 88. Generally, the only condition upon the proximity of second surface 87 to vacuum member 81 is that the communicated vacuum pressure be effective to attract overspray.

A fitting 90 is attached to one opposed end 84 of vacuum member 81. The open bore of the fitting 90 communicates with the interior of the vacuum member 81. The open bore of the fitting 90 is further connected to one end of a conduit 92. Conduit 92 is connected for fluid communication to a vacuum source 94. However, it may be understood that fitting 90 can be attached at a different location of vacuum member 81, such as the opposed end 86 or a lateral position along the peripheral surface 82.

The previously described versions of the present invention have many advantages, including furnishing a simple solution to prevent the occurrence of overspray during the non-contact dispensing of a coating material.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

The scope of the invention itself should only be defined by the appended claims, wherein I claim:

1. Apparatus for controlling overspray of a coating material onto a moving, porous substrate having opposite first and second surfaces from a non-contact liquid dispenser, the apparatus comprising:

an elongate shaft having a hollow interior adapted to be connected to a source of vacuum pressure and an outer peripheral surface with at least one orifice, a vacuum member containing said shaft and connected for rotation about said shaft, said vacuum member having a hollow interior and an exterior portion having a peripheral surface with at least one orifice, and an outer cradle disposed about said exterior portion of said vacuum member and having a longitudinal opening exposing a portion of said peripheral surface of said vacuum member, said opening adapted to be positioned adjacent to the second surface of the porous substrate and in substantially the same plane as said dispenser for attracting airborne particles of the coating material to the first surface of the porous substrate.

2. Apparatus for non-contact dispensing of a coating material onto a moving, porous substrate having opposite first and second surfaces and for controlling overspray of said coating material, the apparatus comprising:

a non-contact coating material dispenser adapted to be mounted adjacent to the first surface of the porous substrate, a source of vacuum pressure, an elongate shaft having a hollow interior attached to said source of vacuum pressure and an outer peripheral surface with at least one orifice, a vacuum member containing said shaft and connected for rotation about said shaft, said vacuum member having a hollow interior and an exterior portion having a peripheral surface with at least one orifice, and an outer cradle disposed about said exterior portion of said vacuum member and having a longitudinal opening exposing a portion of said peripheral surface of said vacuum member, said longitudinal opening adapted to be positioned adjacent to the second surface of the porous substrate and in substantially the same plane as said dispenser for attracting airborne particles of the coating material to the first surface of the porous substrate.

3. Apparatus for non-contact dispensing of a coating material onto a moving, porous substrate having opposite first and second surfaces and for controlling overspray of the coating material, the apparatus comprising:

a non-contact coating material dispenser for applying the coating material onto the first surface of the porous substrate, a source of vacuum pressure, a vacuum member having a hollow interior connected to said source of vacuum pressure and an exterior portion having an orifice adapted to be positioned adjacent to the second surface of the porous substrate to be in substantially the same plane as said dispenser for attracting airborne portions of the coating material to the first surface of the porous substrate, support structure connected with said vacuum member for allowing rotation of said vacuum member such that said vacuum member provides a rotating support for the porous substrate during movement past said non-contact coating material dispenser, and an outer cradle disposed about said exterior portion of said vacuum member, said outer cradle having an opening adapted to expose said orifice to the porous substrate and said cradle providing a seal for said vacuum member in areas disposed outside of said opening.

4. The apparatus of claim 3, further comprising an elongate shaft disposed within the interior of said vacuum member, said shaft having a hollow interior connected to said source of vacuum pressure and at least one orifice communicating said vacuum pressure to said hollow interior of said vacuum member.

5. The apparatus of claim 4, wherein said vacuum member has a plurality of orifices for communicating the vacuum pressure from said shaft to the porous substrate.

* * * * *